US011248884B2

(12) United States Patent
Orsat et al.

(10) Patent No.: US 11,248,884 B2
(45) Date of Patent: Feb. 15, 2022

(54) CARTRIDGE WITH IGNITER CORDS

(71) Applicant: NEXTER MUNITIONS, Versailles (FR)

(72) Inventors: Guillaume Orsat, Bourges (FR); Stéphane Cotet, Bourges (FR); David Barres, Bourges (FR); Lucie Theillier, Bourges (FR)

(73) Assignee: NEXTER MUNITIONS, Versailles (FR)

( * ) Notice: Subject to any disclaimer, the term of this patent is extended or adjusted under 35 U.S.C. 154(b) by 188 days.

(21) Appl. No.: 16/831,603

(22) Filed: Mar. 26, 2020

(65) Prior Publication Data

US 2020/0378733 A1 Dec. 3, 2020

(30) Foreign Application Priority Data

Mar. 27, 2019 (FR) ..... 1903116

(51) Int. Cl.
*F42B 5/08* (2006.01)
*F42B 5/18* (2006.01)
(Continued)

(52) U.S. Cl.
CPC ..... *F42B 5/08* (2013.01); *C06C 5/06* (2013.01); *F42C 19/083* (2013.01);
(Continued)

(58) Field of Classification Search
CPC ..... F42C 19/08; F42C 19/12; F42C 19/083; F42C 19/0894; F42B 5/02; F42B 5/08;
(Continued)

(56) References Cited

U.S. PATENT DOCUMENTS 4,220,087 A 9/1980 Posson
4,917,017 A * 4/1990 Beltz ..... C06C 5/04 102/275.1
(Continued)

FOREIGN PATENT DOCUMENTS

EP 0047384 B1 * 5/1985 ..... F42B 5/073
EP 0344098 A1 11/1989
(Continued)

OTHER PUBLICATIONS

Jan. 10, 2020 French Search Report and French Written Opinion issued in French Patent Application No. 1903116.

*Primary Examiner* — James S Bergin
(74) *Attorney, Agent, or Firm* — Oliff PLC

(57) ABSTRACT

The invention relates to a cartridge having a projectile secured to a case that contains a propelling charge and closed by a base. A device for igniting the propelling charge has at least two energetic igniter cords that extend between an initiating means secured to a rear part of the case and the projectile. In this cartridge, the cords are joined at their rear part so as to form a strand, and they are fastened by at least one fastening means secured to the cartridge, the strand being connected to the initiating means by a packing gland making it possible to immobilize the cords both radially and axially relative to the initiating means while keeping the cords tight between their fastening means and the initiating means.

7 Claims, 2 Drawing Sheets

(51) Int. Cl.

| | |
|---|---|
| ***F42B 12/06*** | (2006.01) |
| ***F42B 14/06*** | (2006.01) |
| ***F42C 19/08*** | (2006.01) |
| ***F42C 19/12*** | (2006.01) |
| ***C06C 5/06*** | (2006.01) |
| *F42B 5/045* | (2006.01) |

(52) U.S. Cl.
CPC ..... *F42C 19/0834* (2013.01); *F42C 19/12* (2013.01); *F42B 5/045* (2013.01); *F42B 5/18* (2013.01); *F42B 12/06* (2013.01); *F42B 14/061* (2013.01)

(58) Field of Classification Search
CPC .. F42B 5/18; F42B 5/045; F42B 12/06; F42B 14/06; F42B 14/061; C06C 5/06
USPC ..... 102/472
See application file for complete search history.

(56) References Cited

U.S. PATENT DOCUMENTS

| | | | | |
|---|---|---|---|---|
| 5,129,324 | A | 7/1992 | Campoli | |
| 5,179,250 | A | 1/1993 | Campoli | |
| 5,183,961 | A * | 2/1993 | Campoli | F42B 5/067 102/439 |
| 5,325,785 | A * | 7/1994 | Gardner | F42C 19/0834 102/430 |
| 5,400,715 | A * | 3/1995 | Roach | F42B 5/181 102/202 |
| 6,450,099 | B1 | 9/2002 | Desgland | |
| 6,477,958 | B1 | 11/2002 | Leblond et al. | |
| 6,691,621 | B2 * | 2/2004 | Pierrot | F42B 5/16 102/202.14 |
| 6,708,621 | B1 | 3/2004 | Forichon-Chaumet et al. | |
| 7,610,856 | B2 * | 11/2009 | Stark | F42B 5/18 102/431 |

FOREIGN PATENT DOCUMENTS

| | | | | |
|---|---|---|---|---|
| EP | 1092939 | A1 | 4/2001 | |
| EP | 1092940 | A1 | 4/2001 | |
| EP | 1431701 | A1 * | 6/2004 | F42B 5/192 |
| FR | 2441598 | A1 | 6/1980 | |
| FR | 2620214 | A1 | 3/1989 | |
| FR | 2801667 | A1 | 6/2001 | |

* cited by examiner

CARTRIDGE WITH IGNITER CORDS

The technical field of the invention is that of cartridges comprising a propelling charge housed in a case and ignition devices for such propelling charges.

It is known to produce cartridges in which the ignition device for the propelling charge includes energetic igniter cords that extend between an ignition means secured to a rear part of the case and the projectile.

The following patents may for example be considered: U.S. Pat. Nos. 5,129,324, 5,179,250 and EP 1,092,940.

The igniter cords most often comprise a tube made from plastic containing a pyrotechnic composition such as black powder or a composition combining boron and potassium nitrate or aluminum and potassium perchlorate. These cords are well known and in particular described by patent FR 2,441,598.

The igniter cords make it possible to ensure an ignition of the propelling charge in a cartridge whose projectile deeply penetrates inside the powder bed, in particular for a projectile of the arrow type with a long bar. Indeed, the conventional axial igniter tubes cannot be incorporated with such projectiles.

In the known cartridges with igniter cords, the cords extend between an axial igniter tube connected to the base and the case or the projectile. In particular, in patents U.S. Pat. Nos. 5,129,324 and 5,179,250, the cords are positioned along the inner wall of the case and they are held in place by stars made of plastic.

Such a solution allows pivoting movements of the cords relative to the axis of the cartridge. Friction with the grains of powder is then possible, which may lead to pyrotechnic incidents during ammunition transport phases.

Furthermore, the holding stars risk creating unburnts as well as disrupting the propagation of the ignition flow.

The cartridge described by patent EP 1,092,940 includes igniter cords grouped into a strand that is introduced into an axial igniter cap.

Here again, however, movements of the cords or the strand relative to the powder bed are possible, which may lead to pyrotechnic incidents. Additionally, during transport phases, the strand may be extracted from the cap and lead to a catastrophic event during the ignition.

It is the aim of the invention to propose a cartridge architecture not including such drawbacks.

Thus, the cartridge according to the invention provides reliable positioning of the igniter cords, guaranteeing the resistance of the cartridge to vibrations and impacts in particular due to transport.

This reliable positioning also ensures ignition with reproducible pyrotechnic characteristics and without pressure waves.

Thus, the invention relates to a cartridge comprising a projectile secured to a case containing a propelling charge and closed by a base, a device for igniting the propelling charge comprising at least two energetic igniter cords extending between an initiating means secured to a rear part of the case and the projectile, in which cartridge the cords are joined at their rear part so as to form a strand, the cartridge being characterized in that the cords are fastened by at least one fastening means secured to the cartridge, the strand being connected to the initiating means by a packing gland making it possible to immobilize the cords both radially and axially relative to the initiating means while keeping the cords tight between their fastening means and the initiating means.

Advantageously, the packing gland can include a sheath surrounding the strand and on which a nut is positioned that engages on a thread borne by the initiating means, the nut including a conical seat engaging on the sheath during the tightening.

The initiating means can include an inner chamber in which at least one igniting relay is positioned, the strand being fastened near the igniting relay.

According to one embodiment, the fastening means may make it possible to fasten each cord to the body of the projectile.

According to one specific embodiment, the projectile is an arrow-type projectile, the body of which includes a full-caliber sabot surrounding a sub-caliber bar, and at least one fastening means is secured to the sabot.

According to another embodiment, at least one fastening means makes it possible to fasten each cord to a ring providing the connection between the case and the projectile.

According to embodiment variants, the fastening means will be able to comprise at least one clamp secured to a rod engaged in the body of the projectile.

The invention will be better understood upon reading the following description of specific embodiments, the description being done in reference to the appended drawings and in which.

Figure 1:
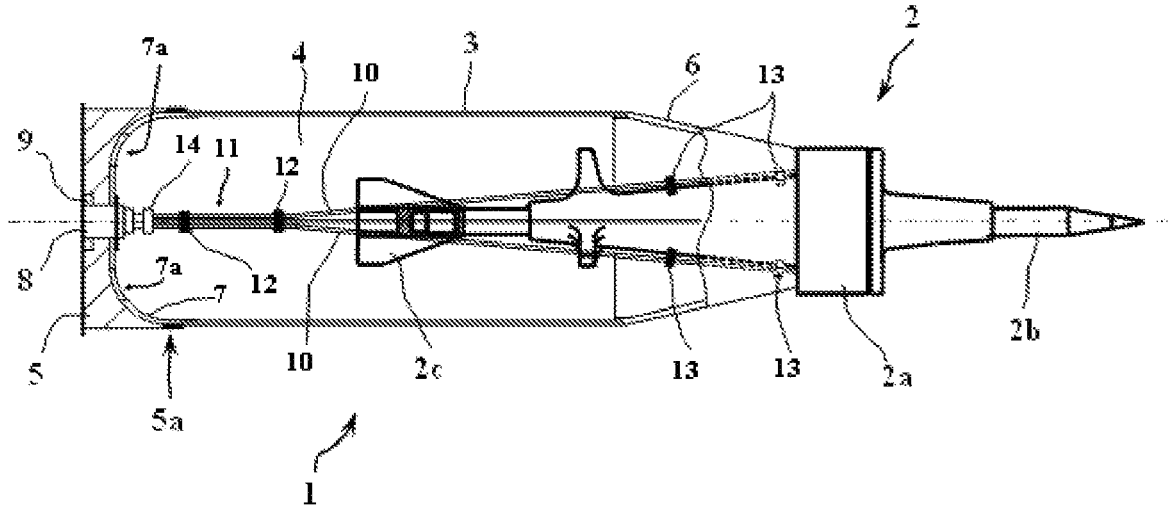
FIG. 1 shows, in partial longitudinal cross-section, a cartridge according to one embodiment of the invention.

In reference to FIG. 1, a cartridge 1 according to the invention comprises a projectile 2 secured to a case 3 that contains a propelling charge 4. The case 3 is closed at its rear part by a metal base 5 that makes it possible to ensure the tightness upon firing in the chamber of the weapon. To that end, the base 5 conventionally bears a deformable peripheral fitting 5*a*, for example made from rubber.

The projectile 2 here is an arrow-type projectile, the body of which includes a full-caliber sabot 2*a* surrounding a sub-caliber bar 2*b* and stabilized by a fin assembly 2*c*.

The case 3 is a combustible case made for example from nitrocellulose. It is fastened to the projectile 2 by a ring 6 made from plastic that provides the connection between the case 3 and the projectile 2.

Patents FR 2,620,214 and FR 2,801,667 describe such a type of connecting ring.

The case 3 is further fastened to the base 5 by means of a rear cup 7 made from plastic. Such a rear cup is described by patent EP 1,092,939. It includes openings 7*a* that are evenly angularly distributed about the axis of the cartridge and thus has the advantage of allowing a placement of the propelling charge 4, through the rear of the case 3, before the fastening of the base 5.

The base 5 is fastened on an axial initiating means 8 that is fastened to the cup 7 as described by patent EP 1,092,939. The base is fastened by a nut 9 that is screwed on the initiating means 8.

The device for igniting the propelling charge 4 includes at least two energetic igniter cords 10 that extend between the initiating means 8 and the projectile 2.

Figure 3:
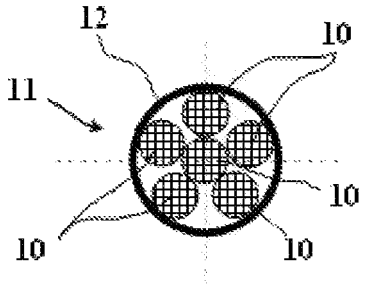
FIG. 3 is a cross-sectional view of the strand formed by the igniter cords.

As shown in FIG. 1, the cords 10 are brought together at their rear part so as to form a strand 11. This connection of the cords 10 in a single strand 11 may be done using adhesive strips 12. FIG. 3 shows a section taken at the strand 11. In the embodiment that is shown here, there are six identical cords 10, grouped together by a sheath 12 that is for example formed by one or several layers of adhesive strips. It would also be possible to make the strand 11 with a heat-shrink sheath 12.

The cords are igniter cords of the type described by patents U.S. Pat. Nos. 5,129,324, 5,179,250, FR 2,441,598 and EP 1,092,940.

Each cord conventionally includes a tube made from plastic (for example, polyethylene) that contains an oxidation-reduction composition, such as a composition combining boron and potassium nitrate or aluminum and potassium perchlorate.

The cords 10 are individually fastened at their front end by at least one fastening means 13 that is secured to the cartridge 1, for example secured to the projectile 2 itself.

It would also be possible to fasten the front ends of the cords 10 to the connecting ring 6 (embodiment not shown).

As shown in FIG. 1, it will be possible to provide several fastening means 13 between each cord 10 and the projectile 2.

At the rear part of the cords 10, the strand 11 is connected to the initiating means 8 by a packing gland 14.

Figure 2:
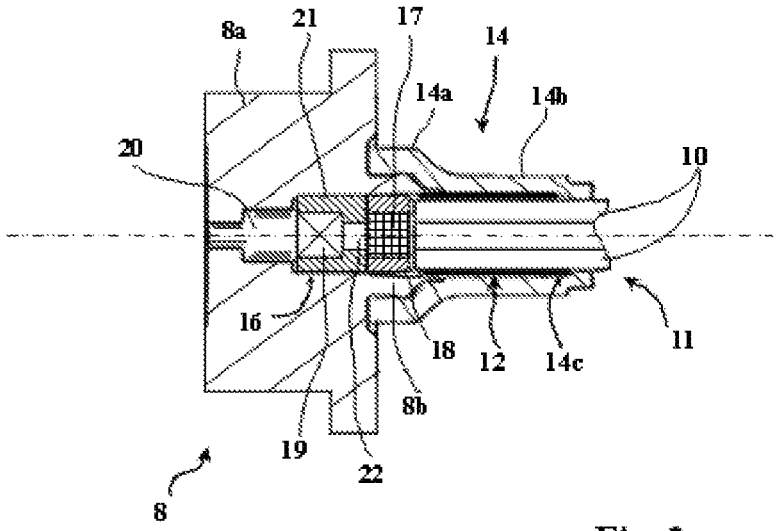
FIG. 2 is an enlarged view of the initiating means for initiating the igniter cords.

FIG. 2 more specifically shows the structure of the initiating means 8, which includes a rear block 8*a* on which is fastened the nut 9 connecting the base, the rear block 8*a* including a threaded forward extension 8*b*, of reduced diameter, which receives the internal thread of the packing gland 14 which has the form of a ring including a flared rear part 14*a* that bears the internal thread and a forward part 14*b* that delimits a bore substantially with the diameter of the strand 11 and that ends with a conical seat 14*c* that bears on the sheath 12, here formed by adhesive strips surrounding the strand 11. The rear part 14*a* of the packing gland therefore constitutes a nut engaged on the thread of the extension 8*b* of the initiating means 8.

Thus, the packing gland 14 makes it possible to immobilize the cords 10 both radially and axially relative to the initiating means 8.

The tightening of the nut 14*a* of the packing gland 14 will exert traction on the strand 11 and the conical seat 14*c* will push the sheath 12, increasing the tightening and the traction exerted on the cords 10.

The device proposed by the invention thus makes it possible to keep the cords 10 slightly tight between their fastening means 13 and the initiating means 8. Just enough tension will be given to avoid any floating of the cord 10 relative to the projectile 2.

This results in better pyrotechnic safety, since the risks of detachment of the cords 10 as well as friction of these cords on the powder bed are reduced.

This also results in improved reliability of the ignition of the cartridge and decreased unburnts. The invention also makes it possible to facilitate wrapping relative to the known solutions. This solution is therefore well suited to serial production.

As can be seen in FIG. 2 as well, the initiating means includes an inner axial chamber 16 in which an ignition relay 17 is positioned that is held in place by a support ring 18.

An igniter 19 is housed in the chamber 16, at a distance from the igniter relay 17. An igniter block 20 completes the assembly. It is intended to conduct the electrical current supplied by the weapon and ensuring the initiation of the igniter 19. The block 20 is electrically insulated from the rear block 8*a* of the initiating means 8. As shown in FIG. 2, the igniter 19 is positioned in a support ring 21 that bears a hole 22 across from the relay 17. It may of course have several relays 17 depending on the needs.

The strand 11 is therefore fastened near the igniter relay 17. All of the cords 10 are ignited at the same time upon initiation of the relay 17.

Figure 4:
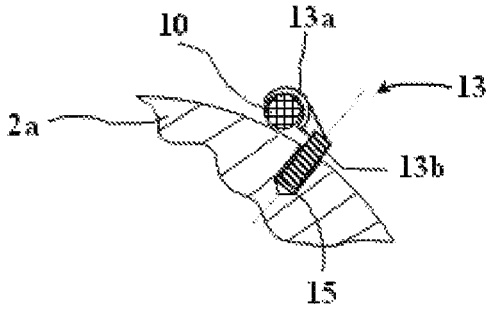
FIG. 4 shows an example of a fastening means for fastening an igniter cord to the projectile body.

FIG. 4 shows an example of a means 13 for fastening on the sabot 2*a* of the projectile 2.

This fastening means here is made up of a clamp 13*a* secured to a rod 13*b* that is introduced by force into a hole 15 arranged in the projectile 2.

The clamp 13*a* and rod 13*b* are made in a monobloc form and from a plastic, for example from polyethylene. The clamp 13*a* has an inner diameter substantially equal to that of the cord 10 and it will include, on its inner face that comes into contact with the cord 10, an indentation (or bead) ensuring the pinching of the cord 10 and preventing it from being pulled out.

During the ignition of the propelling charge 4, the clamps 13 are destroyed by the pressure from the gases.

It is of course possible to combine several clamps 13 on a same cord 10 and to associate them with adhesive strips 12 that will be used as fastening means in place of the clamps, in locations on the projectile 2 for which there is not enough material to house a rod 13*b*.

As a variant, similar clamps could be manufactured in a single piece with the connecting ring 6 to allow an attachment of the cords 10 on the connecting ring 6.

The invention has been described as it applies to a cartridge containing a sub-caliber projectile. It is of course possible to implement it with a projectile of a different nature, for example a full-caliber explosive projectile.

The invention claimed is:

1. A cartridge comprising a projectile that is secured to a case, wherein the case contains a propelling charge and is closed by a base, the cartridge comprising a device for igniting the propelling charge, said device comprising at least two energetic igniter cords extending between an initiating means secured to a rear part of the case and the projectile, in which cartridge the cords are joined at their rear part so as to form a strand, wherein the cords are fastened by at least one fastening means secured to the cartridge, the strand being connected to the initiating means by a packing gland making it possible to immobilize the cords both radially and axially relative to the initiating means while keeping the cords tight between their fastening means and the initiating means.

2. The cartridge according to claim 1, wherein the packing gland includes a sheath surrounding the strand and on which a nut is positioned that engages on a thread borne by the initiating means, the nut including a conical seat engaging on the sheath during the tightening.

3. The cartridge according to claim 2, wherein the initiating means includes an inner chamber in which at least one igniting relay is positioned, the strand being fastened near the igniting relay.

4. The cartridge according to claim 1, wherein the fastening means makes it possible to fasten each cord to a body of the projectile.

5. The cartridge according to claim 4, wherein the projectile is an arrow-type projectile, the body of which includes a full-caliber sabot surrounding a sub-caliber bar, at least one fastening means being secured to the sabot.

6. The cartridge according to claim 1, wherein at least one fastening means makes it possible to fasten each cord to a ring providing a connection between the case and the projectile.

7. The cartridge according to claim 4, wherein the fastening means comprise at least one clamp secured to a rod engaged in the body of the projectile.

* * * * *